US006521299B1

(12) United States Patent
Dessauer

(10) Patent No.: US 6,521,299 B1
(45) Date of Patent: Feb. 18, 2003

(54) METHOD AND DEVICE FOR IMPROVING THE COATING SURFACE OF STRIPS OF PAPER

(75) Inventor: Guido Dessauer, Tutzing (DE)

(73) Assignee: BTG Eclépens S.A., Eclépens (CH)

( * ) Notice: Subject to any disclaimer, the term of this patent is extended or adjusted under 35 U.S.C. 154(b) by 0 days.

(21) Appl. No.: 09/743,006

(22) PCT Filed: Jul. 1, 1999

(86) PCT No.: PCT/EP99/04544

§ 371 (c)(1),
(2), (4) Date: Dec. 29, 2000

(87) PCT Pub. No.: WO00/01887

PCT Pub. Date: Jan. 13, 2000

(30) Foreign Application Priority Data

Jul. 1, 1998 (DE) ..... 198 29 490

(51) Int. Cl.[7] ..... B05D 1/04; B05D 1/26; B05B 5/025

(52) U.S. Cl. ..... 427/471; 427/472; 427/420; 427/428; 427/533; 427/482; 427/483; 118/621; 118/630; 118/638; 118/407

(58) Field of Search ..... 427/209, 326, 427/471, 472, 420, 428, 533, 536, 538, 482, 483; 361/212, 214; 118/410, 621, 626, 627, 636, 638, DIG. 4

(56) References Cited

U.S. PATENT DOCUMENTS

| | | | | |
|---|---|---|---|---|
| 3,498,865 | A | | 3/1970 | Paquin et al. |
| 3,783,826 | A | * | 1/1974 | Urbanek et al. |
| 3,952,700 | A | * | 4/1976 | Little, Jr. et al. |
| 4,086,872 | A | * | 5/1978 | Pan |
| 4,457,256 | A | * | 7/1984 | Kisler et al. |
| 4,576,831 | A | | 3/1986 | Hosoi et al. |
| 5,138,971 | A | * | 8/1992 | Nakajimi et al. |
| 5,318,804 | A | * | 6/1994 | Yoshida |

FOREIGN PATENT DOCUMENTS

| | | |
|---|---|---|
| DE | 2715766 | 10/1978 |
| DE | 3235368 | 3/1984 |
| DE | 3636224 | 5/1987 |
| DE | 3623738 | 1/1988 |
| DE | 19632899 | 2/1988 |
| DE | 4034339 | 7/1991 |
| DE | 4324337 | 1/1995 |
| FR | 1447984 | 6/1966 |

* cited by examiner

*Primary Examiner*—Fred J. Parker
(74) *Attorney, Agent, or Firm*—W. F. Fasse; W. F. Fasse

(57) ABSTRACT

The invention relates to a method and device for improving the coating surface of a coating mass deposited on or applied to a paper web (8, 23) by a film press. An anionic aqueous coating mass or an anionic paper web are provided with an opposite electric charge by an electric charger, whereby the applied coating is attracted to the oppositely charged paper (8, 23) in a nip exit area of the film press. The electric charger is, for example, a corona generator (13, 17) or a direct current voltage source (9) that is connected to the paper (8, 23) and coating slip by electrodes (5, 5*a*, 7, 7*a*).

7 Claims, 3 Drawing Sheets

METHOD AND DEVICE FOR IMPROVING THE COATING SURFACE OF STRIPS OF PAPER

FIELD OF THE INVENTION

The invention relates to coating paper webs with an aqueous coating mass or slip, also referred to as coating paint.

BACKGROUND INFORMATION

The coating paints comprise either one inorganic pigment or a mixture of different inorganic pigments which are bound in one organic binder vehicle or in a mixture of organic binder vehicles. It is known to apply these coating paints onto the paper webs with a so-called film press also as metering size press also known as metering size press. For this purpose the coating paint is applied to a rubber roller of the film press on one or both sides of the web, whereupon the paint is transferred by this roller or these rollers onto the paper web under pressure. When the paper web coated with the coating mass or paint, exits from a nip between the rollers of the film press, a splitting or separation of the coating mass film occurs due to coating disturbing forces generated in the nip exit area because at least some of the coating mass tends to stay on the coating roller rather than be transferred to the web being coated. Thus, a separation of the coating mass within itself occurs. The coating mass is more or less viscous and known rheologic problems occur due to said coating disturbing forces which lead to so-called flow lines or to the orange peel effects which reduce the quality of the coating.

Moreover, such film presses run with a speed of 800 to 2000 m/min., whereby small coating mass particles pass as free fog or spray fog into the space just downstream of the nip where the coating mass splits apart on its way from the wetted roller to contact the paper web due to said speed which increase the coating disturbing forces. Conventionally one must put up with this fog more or less and control it in practice by holding a black cardboard in the vicinity of the nip exit area of the paper web on its way to a drying station. Thus, efforts have been made to influence the adhesion forces between the coating paint and the roller as well as the cohesion forces within the coating paint in such a way that the fog at the nip exit and the so-called orange peel pattern are reduced or avoided. However, these efforts have not led to satisfactory results in practice.

SUMMARY OF THE INVENTION

The invention has for its object to improve the coating surface of produced paper webs and to minimize the generation of spray fog and the so-called orange peel effects.

The above objects have been achieved according to the invention by the combination of the following method steps. First, the charge status or charge polarity of the paper web and of the coating mass are ascertained. Second, the web is passed through the nip between two rollers forming part of a film press or metering size press that performs the coating at a web speed of at least 800 m per minute. Third, the paper web or the coating mass or both are so charged that each has a polarity opposite to the polarity of the other. Fourth, as the coating proceeds in the film press, the opposing charges or polarities generate attraction forces that oppose or counteract the above mentioned coating disturbing forces that are effective in the nip exit area downstream of the nip as viewed in the moving direction of the paper web. The attraction forces thus reduce or even eliminate the above mentioned spray fog and orange peel effects.

The present method is performed by an apparatus according to the invention which is characterized by the following features: a coating station including at least one coating film press for coating at least one surface of said paper web with said coating mass, said film press comprising two rollers forming a nip and nip exit area downstream of said nip as viewed in a moving direction of said paper web through said film press, a drive for moving said paper web through said nip and nip exit area in said moving direction at a web speed of at least 800 meters per minute, and an electric charging device positioned for ionizing at least one of said paper web and said coating mass with a charge polarity so that said paper web and said coating mass have opposing charge polarities at least in said nip exit area for acting against coating disturbing forces tending to disturb said coating mass on said paper web in said nip exit area to reduce spray fog and orange peel effects.

The invention has the advantage that with this method using an aqueous coating mass a more closed that is a smooth surface of the coating is achieved which in turn results in an improved printability of the paper. Furthermore, one achieves with the method according to the invention a printability that was possible heretofore only with thicker coatings. As a result, according to the invention printing products can be produced having a lower mass or weight per square. Since these film presses apply the aqueous coating mass, thinner coatings have been made possible, whereby the printed matter produced with such thinner coatings can be advantageously disposed in an environmentally friendly manner.

Furthermore, due to the suppression of the spray fog, less coating mass and fewer cleaning stops are required for the coating equipment, whereby the costs of the thus-coated papers can also be reduced.

BRIEF DESCRIPTION OF THE DRAWINGS

The invention will be explained in more detail with reference to an example embodiment which is shown in the drawing, wherein.

DETAILED DESCRIPTION OF PREFERRED EXAMPLE EMBODIMENTS AND OF THE BEST MODE OF THE INVENTION

Figure 1:
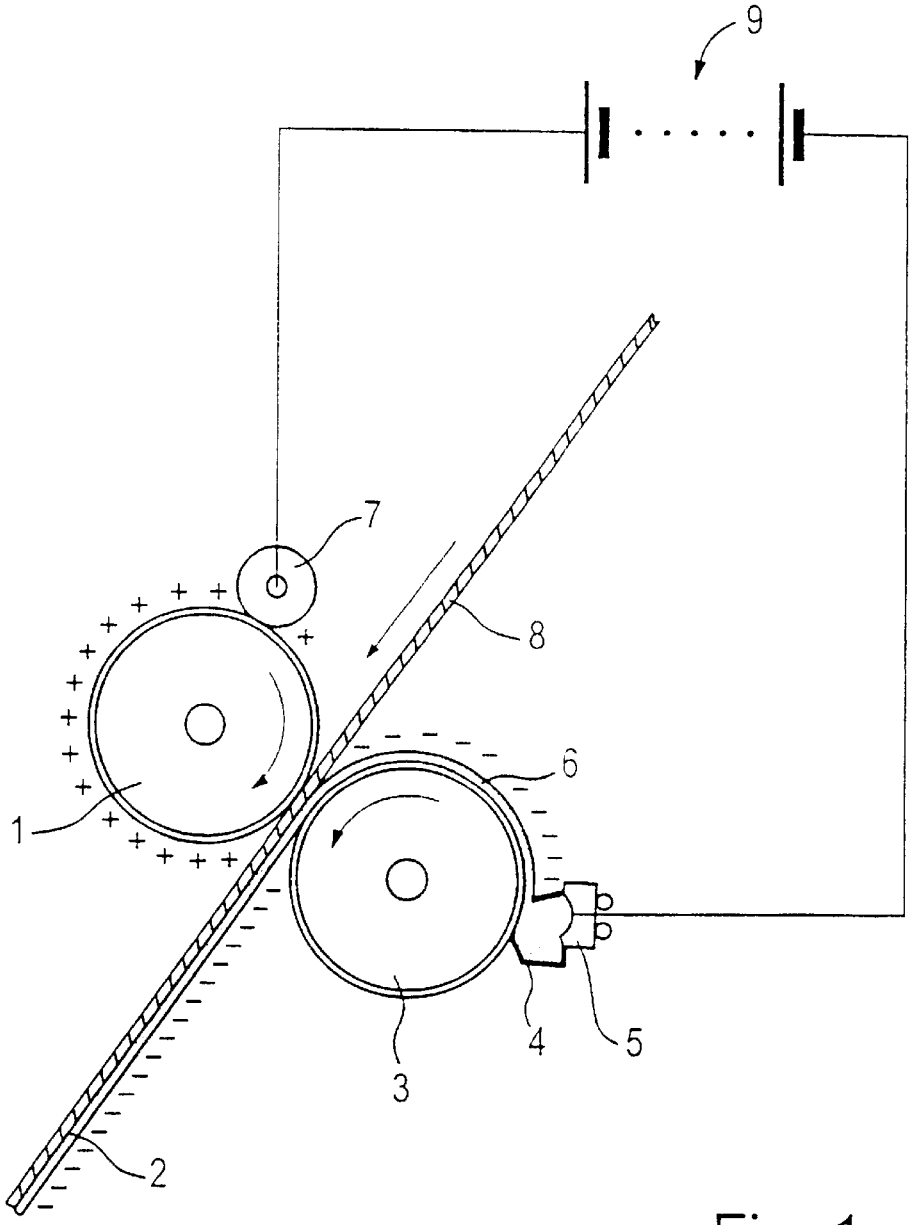
FIG. 1 shows a schematic illustration of a film press that coats but one side of a paper web and which is equipped with an electrical charging device.

FIG. 1 of the drawing shows a schematic film press. A paper web 8 passes through a film press, whereby the paper web is coated on one side for example with an anionic aqueous coating mass 6. A counter roller 1 cooperates with a coating roller 3. The counter roller 1 is positively ionized by an electric charging device, whereby the counter roller 1 becomes attractive for the anionic aqueous coating mass 6.

The counter roller 1 and the coating roller 3 of the film press form two film pressing rollers of which the lower roller forms the coating roller 3 and the upper roller forms the counter roller 1. Both rollers 1 and 3 are provided with a rubber jacket. The rollers 1 and 3 form a nip through which the paper web 8 is transported with a web speed of at least 800 meter per minute by driving the rollers 1 and 3 in opposite directions. The paper web 8 passes through the nip between the contact surfaces of the rollers 1 and 3 in a predetermined direction so as to also pass through a nip exit area. The coating roller 3 of the film press is provided with a precoating device 4 which applies the coating mass 6 to the coating roller 3. The coating mass 6 is, for example, applied uniformly onto the surface of the coating roller 3 with a conventional doctor blade. The roller 3 entrains the coating mass 6 as a film on its surface in the rotational direction. As the coating roller 3 rotates the coating mass is applied to the underside 2 of the passing paper web B. Since the two rollers 1 and 3 counter-rotate relative to each other under a predetermined pressure, the aqueous coating mass is partially dehydrated so that a defined layer of the coating mass is applied to the underside of the paper web 2.

The above mentioned free fog or spray fog and orange peel effect occur in the nip exit area unless a counteracting force that works against the spray fog and orange peel effect is applied as taught by the invention.

The precoating device 4 which is intended to apply the coating mass 6 in an optimal distribution, constitutes an electrode (cathode) 5 which is in electrical contact with the dispersed coating mass which can be considered as an electrokinetic system. The negative pole of a voltage source 9 is connected with the electrode 5. An idling metal roller 7 is arranged at the counter roller 1. The idling roller 7 functions as a second electrode (anode) which is connected to the positive pole of the d.c. voltage source 9. The rubber jacket of the upper film press roller 1 consists of an electrically conducting rubber mixture so that the paper 8 is charged with a positive electrical charge. In this connection, the electrodes 5 and 7 and the voltage source 9 as well as the electrically conducting roller jackets constitute an electrical charging device. It is suitable to select for the electrical charging a d.c. voltage source 9 which provides a voltage of about 150 to 2000 V. Other example embodiments may use higher voltages up to 10000 V.

Figure 2:
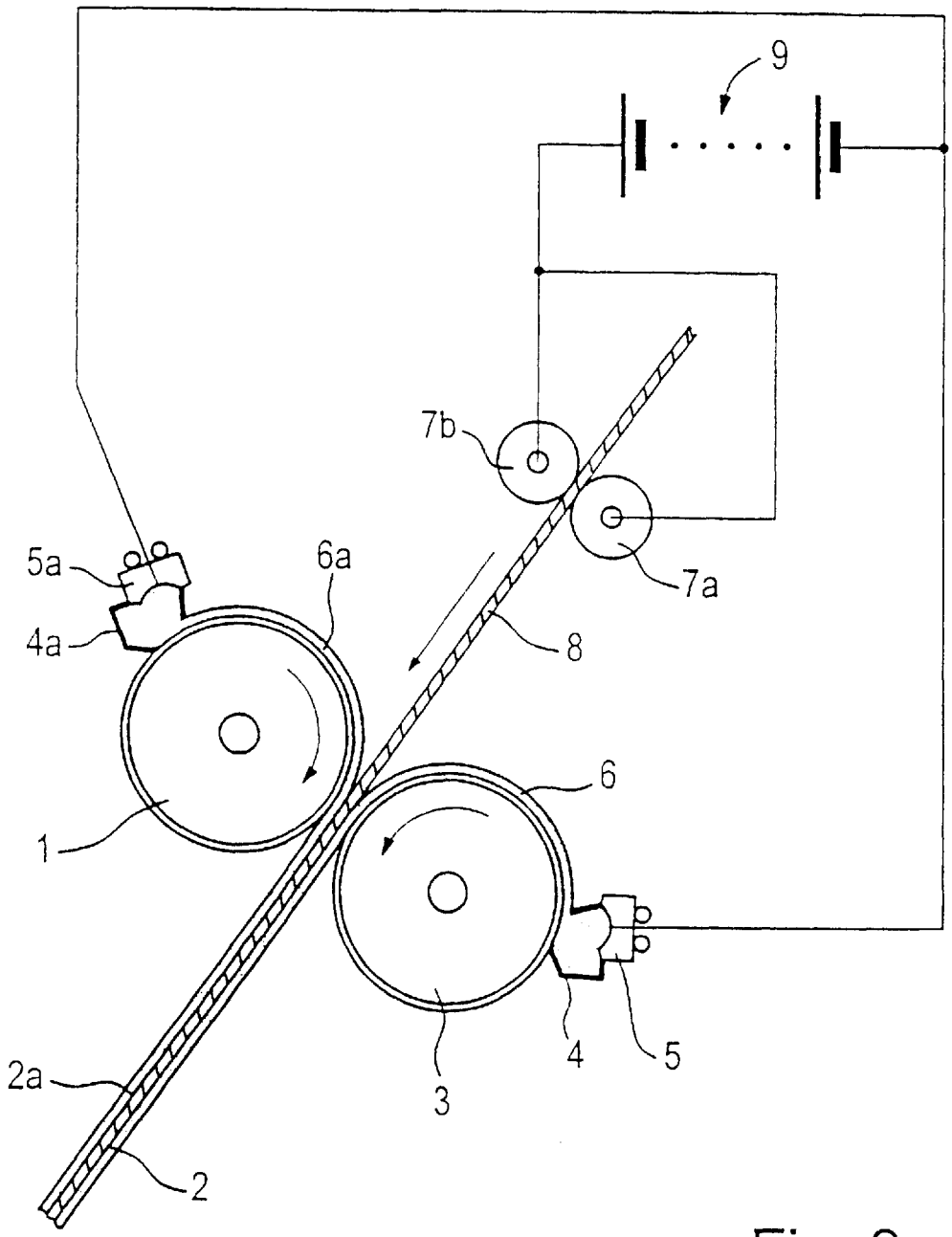
FIG. 2 is a schematic illustration of a film press that coats two sides of a paper web and includes an electric charging device.

FIG. 2 of the drawings shows schematically a film press for coating both sides of a paper web. The film press is substantially the same as described with reference to FIG. 1. The film press is provided with several different additional devices in order to make possible the coating of both sides of the web. The same components a re thus also provided with the same reference numbers as in FIG. 1 of the drawings.

In FIG. 2 of the drawings the two film press rollers 1 and 3 are shown which both are constructed as coating rollers. The paper web 8 passes continuously between the contact surfaces of the rollers 1 and 3. The two coating rollers 1 and 3 wet the paper web 8 on both sides with coating mass. For this purpose each coating roller 1 and 3 is provided with a precoating device 4, 4*a*. These precoating devices uniformly apply the coating mass to the surface of the coating rollers 3 and 1 with the aid of a known doctor blade not shown. As a result, a film 6, 6*a* of coating mass is formed on the roller surfaces and the film is applied to both sides 2 and 2*a* of the paper web 8 passing through between the rollers.

For a better application of the coating mass to both sides 2, 2*a* of the paper web, the two precoating devices 4, 4*a* are connected to a d.c. voltage source 9. For this purpose the precoating devices 4, 4*a* constitute electrodes (cathodes) which are in electrical contact with the dispersed coating mass which can be considered as an electrokinetic system.

Furthermore, two guide rollers 7*a*, 7*b* are provided. The paper web 8 runs through between the contact surfaces of the guide rollers for feeding the web to the coating rollers 1 and 3. These guide rollers are made of electrically conducting material or they are coated with an electrically conducting surface material. Thereby, at least the conducting roller surfaces are connected to the d.c. voltage source 9 for forming the opposing electrodes (anode). In this manner the paper web 8 passing through is charged with a positive electric charge.

Figure 3:
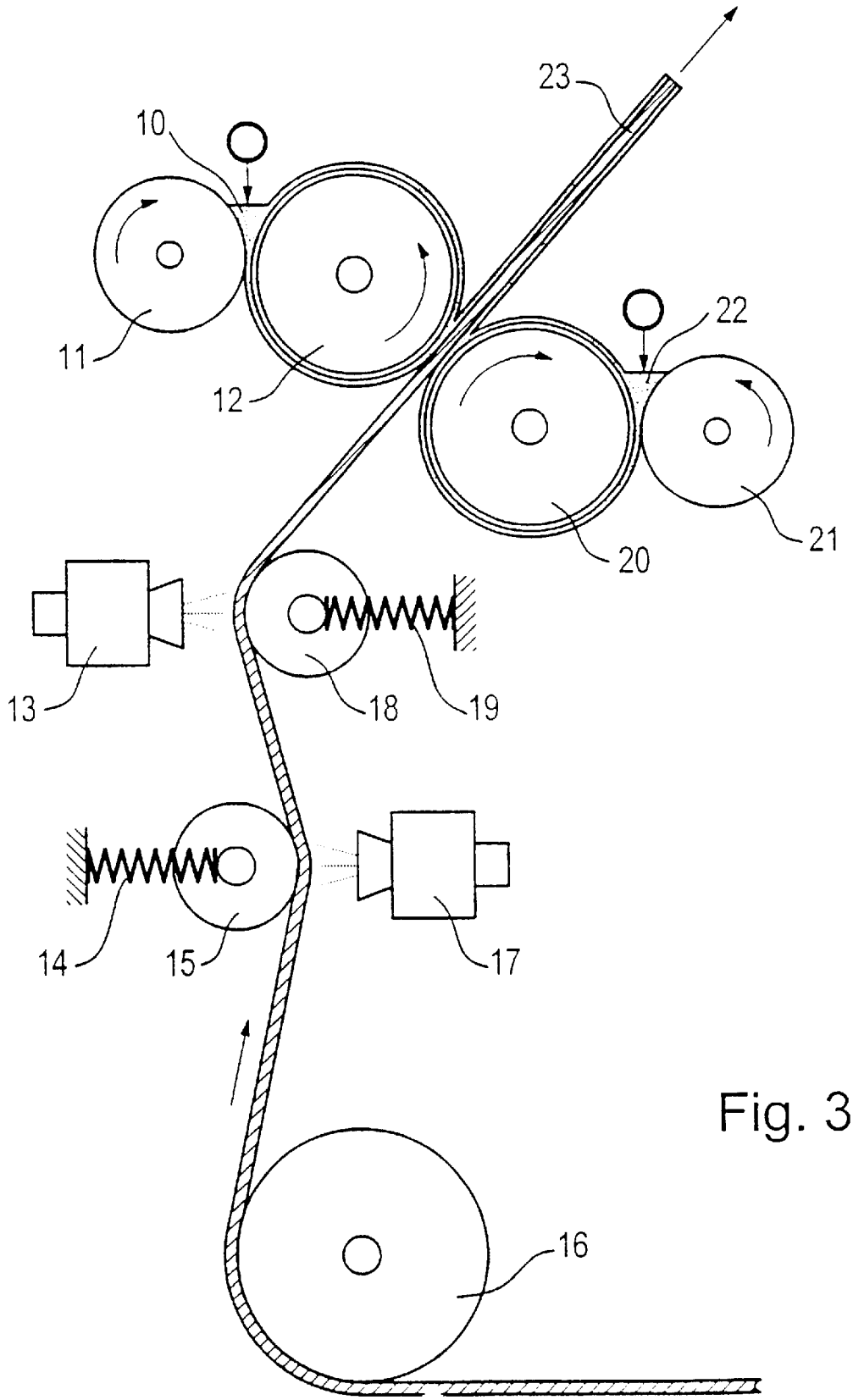
FIG. 3 is a schematic illustration of a film press that coats two sides of a paper web and includes a corona generator as a charging device for each side.

FIG. 3 of the drawings shows schematically a film press by means of which a coating of both sides of the paper web 23 is achieved. Two scattering electrodes referred to as corona generators 13 and 17 form electrical charge devices for applying an opposing charge to the paper web 23 relative to the charge of the coating mass. The paper web 23 to be coated is transported around a detour roller 16 to a first guide roller 15. This guide roller 15 is connected to a compression spring 14 for guiding the paper web 23 close to and past the right-hand corona generator 17, whereby the right-hand paper web surface is charged with an electrical charge. The paper is thereby ionized in opposition to the charge of the coating mass. This ionization is achieved in that the top atom layer of the paper web 23 is oxidized. This corona oxidation makes the paper surface hydrophilic to thereby cause a more rapid water absorption. If the voltage is sufficiently high, additional reactive groups can be formed at the fiber wall of the cellulose, whereby the adhesion of the coating mass on the paper web is improved.

A left-side corona generator 13 including a guide roller 18 provided with a compression spring 19 are positioned above the right-side corona generator 17. The corona generator 13 oxidizes the left paper web surface.

Downstream of the corona generators the paper web 23 passes between two oppositely driven film press rollers 20, 12. A further dosing roller 11, 21 is arranged horizontally next to the film press rollers 20 and 12. The dosing rollers 11 and 21 are also driven in an opposite direction relative to the respective film press roller 12 or 20. The dosing roller 11, 21 is provided with a structurized surface which serves for the uniform wetting of the film press roller 12, 20 with the coating mass. The coating mass is introduced into the upper nip 10, 22 of the respective film press roller 12, 20 and the corresponding dosing roller 11 and 21. The surface of the film press roller 11, 21 applies the coating mass to the respective two paper surface sides of the paper web 23 passing through. Thereby, the application of the coating mass takes place in accordance with the above description of FIG. 1.

The method performed with the above described devices for the application of the coating mass to the paper web 8, 23 is based on the following principle.

The aqueous coating masses constitute an electrokinetic system, whereby each pigment has a zeta-potential in this aqueous system. Thereby, the coating masses are dispersed because the pigments have electrokinetic repulsion forces.

Thus, the invention is based on the recognition that using these electrokinetic forces in the separation of the coating mass films from the coating roller improves the transfer of the films onto the paper web 8, 23. Heretofore, all conventional coating paints have been anionic and it was necessary to transfer these anionic conventional coating paints onto anionic paper. Therefore, it was also necessary to overcome the electrokinetic repulsion forces in order to obtain a more homogeneous coating application. For this purpose, the method according to the invention uses a reverse charging for influencing the ionogenic characteristic of the paper web and of the coating mass in such a way that the electrokinetic repulsion forces which are part of the above mentioned coating disturbing forces between the paper web 8, 23 and the pigments of the coating mass and thus of the coating mass itself are neutralized. For example, the coating mass can be charged so that its ionogenic characteristic is cationic while the paper is charged so that its ionogen characteristic is anionic or vice versa. It is only critical that an opposing charge difference exists between the paper web 8, 23 and the coating mass 6 so that an electrokinetic attraction is established between the coating mass and the paper web 8, 23 particularly in the nip and nip exit area. It is also possible to use right away cationic coating masses and anionic paper because in this context the electrokinetic forces would also advantageously influence the coating operation. However, currently, this is not customary because the problems connected therewith have not been solved. In any case, the use of cationic coating masses in the method described herein would serve for increasing the electric charge differences to thereby cause an improvement in the coating application.

A completely unexpected effect has been achieved according to the invention, because the opposing electrical charges of the coating mass and the paper web 8, 23 are effective in the nip exit area of the film press, whereby a homogeneous coating is obtained without the orange peel effect. Further, the spray fog at the nip exit or nip exit area of the film press roller 3 has been reduced. The coating disturbance or splitting of the coating mass takes place in the nip exit area regardless whether the paper web is coated on one side or on both sides. The disturbance carries a portion of the coating paint or mass that has been predosed on the film press roller. Thereby a portion of the water is already taken up by the paper web, so that the concentration is increased, more specifically the solid content of the coating mass or paint is increased, while still providing the required mobility of the coating mass. In this nip zone or nip exit area the adhesion of the coating mass to the paper web plays an important role on the paper surface as well as on the coating mass dispensing application roller 1, 3. The invention has recognized the importance and it has been shown in practice, that during the splitting process the pigments and the vehicle tend to move toward the cathode if they have an anionic charge and to move toward the anode if they have a cationic charge, whereby the spray fog is reduced due to the opposite charges effective in the nip exit area. The pigments and the vehicle torn out during the splitting repulse one another because they have the same zeta-potential. Simultaneously, the coating on the paper web coming out of the nip is more homogeneous which, following drying, improves the printability of the paper.

Due to the electric charging or reverse charging of the coating mass and the paper web 8, 23 it was thus possible to obtain a more homogeneous coating application and to minimize the formation of spray fog. In this connection the polarity of the charged element such as the paper web 8, 23 and the coating mass is not critical. Rather, an opposing charge difference is necessary which permits the electrokinetic attraction forces to become effective. Thus, the invention can be realized in other embodiments as far as thereby an opposing charge is achieved by means of which the electrokinetic attraction forces can become effective.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method for coating at least one surface of a web with an aqueous coating mass, comprising the following steps:

(a) determining a polarity of a charge state of said web and of said aqueous coating mass;

(b) passing said web in a moving direction with a web speed of at least 800 m/minute through a nip formed between a first roller rotating in one direction and a second roller rotating in an opposite direction, whereby nip forming surfaces of said first and second rollers move in the same direction where said nip is formed for transporting said web and said aqueous coating mass through said nip at said web speed;

(c) applying said aqueous coating mass to at least one of said first and second rollers upstream of said nip for moving said coating mass through said nip;

(d) coating said at least one surface of said web with said aqueous coating mass as said web passes through said nip, and (e) making certain that said web and said aqueous coating mass have opposing polarities at least in a nip exit area downstream of said nip to provide an attraction force between said web and said aqueous coating mass at least in said nip exit area, whereby said attraction force caused by said opposing polarities between said web and said aqueous coating mass acts against spray fog formation, against orange peel effects, against repulsion forces, and against splitting tendencies of said aqueous coating mass passing through said nip exit area for forming a homogeneous coating having a closed surface.

2. The method of claim 1, wherein said step of making certain is a charging step that ionizes at least one of said aqueous coating mass and said web to have opposing polarities at least in said nip exit area.

3. The method of claim 1, wherein said step of making certain is a charging step performed by at least one scattering corona generator for ionizing at least one of said web and said aqueous coating mass to have opposing polarities at least in said nip exit area.

4. The method of claim 1, wherein said step of making certain is a charging step that is applied to said web and to said aqueous coating mass at least in said nip exit area.

5. An apparatus for coating at least one surface of a web with an aqueous coating mass, said apparatus comprising a coating station including at least one metering size press for coating at least one surface of said web with said aqueous coating mass, said at least one metering size press comprising at least two rollers forming a nip and nip exit area downstream of said nip as viewed in a moving direction of said web through said nip between said rollers, a drive for rotating said at least two rollers in opposite directions so that nip forming surfaces of said two rollers move in the same direction where said nip is formed and for moving said web and said aqueous coating mass through said nip and nip exit area in said moving direction at a web speed of at least 800 meters per minute, a coating mass supply positioned for applying said aqueous coating mass to at least one of said two rollers upstream of said nip as viewed in said moving direction, and an electric charging device positioned for ionizing at least one of said web and said aqueous coating mass at least in said nip exit area with a charge polarity so that said web and said aqueous coating mass have opposing charge polarities at least in said nip exit area for acting against forces tending to cause spray fog, against orange peel effects, against repulsion forces, and against splitting tendencies of said aqueous coating mass occurring in said nip exit area for forming a homogeneous coating having a closed surface.

6. The apparatus of claim 5, wherein said electric charging device comprises a direct current power source having a positive terminal and a negative terminal, an anode electrically connected to said positive terminal, a cathode electrically connected to said negative terminal, and conductors electrically connecting one of said cathode and said anode to one of said web and said aqueous coating mass for oppositely charging said web and said aqueous coating mass at least in said nip exit area.

7. The apparatus of claim 5, wherein said electric charging device comprises at least one scattering corona generator (13, 17) positioned upstream of said nip and sufficiently close to said web for ionizing at least one surface of said web at least in said nip exit area.

* * * * *